United States Patent [19]

Ninomiya et al.

[11] Patent Number: 4,766,060

[45] Date of Patent: Aug. 23, 1988

[54] SILVER HALIDE PHOTOGRAPHIC MATERIAL

[75] Inventors: Hidetaka Ninomiya, Mitaka; Ryosuke Sato, Hino, both of Japan

[73] Assignee: Konishiroku Photo Industry Co., Ltd., Tokyo, Japan

[21] Appl. No.: 878,078

[22] Filed: Jun. 24, 1986

[30] Foreign Application Priority Data

Jul. 1, 1985 [JP] Japan ..... 60-144352

[51] Int. Cl.[4] ..... G03C 7/38; G03C 7/32

[52] U.S. Cl. ..... 430/553; 430/385; 430/472; 430/473

[58] Field of Search ..... 430/472, 473, 385, 553

[56] References Cited

U.S. PATENT DOCUMENTS

| | | | |
|---|---|---|---|
| 3,822,248 | 7/1974 | Loria | 430/543 |
| 4,248,962 | 2/1981 | Lau . | |
| 4,288,532 | 9/1981 | Seoka et al. | 430/385 |
| 4,414,308 | 11/1983 | Hamada . | |
| 4,438,194 | 3/1984 | Hamada . | |
| 4,526,861 | 7/1985 | Ichijima et al. | 430/385 |

FOREIGN PATENT DOCUMENTS

3209996A1 10/1982 Fed. Rep. of Germany .

*Primary Examiner*—Paul R. Michl
*Assistant Examiner*—Mark R. Buscher
*Attorney, Agent, or Firm*—Finnegan, Henderson, Farabow, Garrett & Dunner

[57] ABSTRACT

A silver halide photographic material containing a cyan coupler represented by the formula:

wherein, $R_1$ is selected from the group consisting of an acylamino group, an alkylsulfonamido group, an arylsulfonamido group, a carbamoyl group, a sulfamoyl group, an alkylureido group, an arylureido group, an alkyl group, an alkoxy group, an amino group, an alkoxycarbonyl group and a arylcarbonyl group, said groups have at least one carboxy group as a substituent, $R_2$ is selected from the group consisting of a hydrogen atom, a halogen atom, an alkyl group, an alkoxy group, a nitro group, a cyano group, a formyl group, a carboxyl group, a hydroxyl group, an amino group, an acylamino group, an alkylsulfonamido group, an arylsulfonamido group, an alkylureido group, an arylureido group, a sulfamoyl group, a carbamoyl group, an alkoxycarbonyl group and an aryloxycarbonyl group, $R_3$ represents an alkyl group substituted with a phenoxy group; $R_4$ represents a hydrogen atom or an alkyl group, n represents an integer of 1 to 4, provided that when n is 2 or more the groups represented by the plurality of $R_2$ may be either same or different from each other, and that the total number of carbon atoms contained in the groups represented by $R_3$ and $R_4$ is 10 or more.

9 Claims, No Drawings

SILVER HALIDE PHOTOGRAPHIC MATERIAL

BACKGROUND OF THE INVENTION

The present invention relates to a silver halide photographic material, and more particularly to a silver halide photographic material containing a 2-equivalent naphthol-type cyan coupler.

In the subtractive color photographic process, as is well-known, a dye image is formed by the oxidiazation-coupling reaction effected inside silver halide emulsion layers between the oxidized product of an aromatic primary amine color developing agent produced when the developing agent reduces exposed silver halide grains and couplers which form yellow, cyan and magenta dyes. In the process, in general, open-chain active methylene group-having compounds are used as the yellow coupler for the formation of an yellow dye; pyrazolone-type, pyrazolotriazole-type, pyrazolinobenzimidazole-type, indazolone-type, and the like-type compounds are used as the magenta coupler for the formation of a magenta dye; and phenol-type and naphthol-type compounds are used as the cyan coupler for the formation of a cyan dye.

Those couplers which are unsubstituted at their reaction active sites are called four-equivalent couplers, which require stoichiometrically four-molar silver halide for the formation of a one-molar dye.

On the other hand, those couplers which are substituted at their reaction active sites by a group that can be split off without being affected by oxidation reaction are called two-equivalent couplers, which require only two-molar silver halide for the formation of a one-molar dye and therefore are useful for the economy of silver and which, because of being capable of improving the color-forming reaction speed, is known to have various other improving effects such as increasing the photographic speed, shortening the processing period of time through reducing the thickness of a silver halide photographic material, raising the image sharpness, and the like.

There are also known those various compounds produced by introducing into the reaction active sites of such couplers photographically useful groups (such as development inhibitors, development accelerators) or the precursors thereof, which release imagewise such photographically useful groups during the coupling reaction with the oxidized product of a developing agent.

Thus such two-equivalent couplers are intrinsically advantageous and are of wide application as compared to four-equivalent couplers, and therefore have a tendency to be frequently used lately.

Various attempts have been made with respect to making two-equivalent-type those naphthol-type cyan couplers conventionally used for the formation of cyan dyes.

For example, U.S. Pat. No. 3,227,554 describes those compounds having heterothio groups or arylthio groups as the substituent to the reaction active site. These compounds, however, although applicable to such a special use as of the inhibitor-releasing coupler, cannot be practically used as the image forming coupler due to their low dye-forming speed.

Those compounds formed by substituting couplers at their reaction active sites with a sulfonamido, acylamino, imido or the like group are also described in U.S. Pat. Nos. 3,737,316 and 3,458,315, Japanese Patent Publication Open to Public Inspection (hereinafter referred to as Japanese Patent O.P.I. Publication) Nos. 25228/1975 and 21828/1976, and the like. However, they are still inadequate in the dye-forming speed and cannot make the most of the merit as the two-equivalent coupler.

Those most excellent as the reaction-active-site-substituent to two-equivalent couplers are alkyloxy groups and aryloxy groups, some of which groups are practically used. Typical examples of such groups are described in U.S. Pat. Nos. 3,476,563 and 3,822,248, Japanese Patent O.P.I. Publication Nos. 112038/1975, 18315/1977, 48237/1979, 32071/1980, 27147/1981, 12643/1981, and the like.

However, it is known that, even in these two-equivalent couplers, their dye forming reaction efficiency to the developing reaction of exposed silver halide grains is still low. The information media to combine these two reactions include the oxidized product of a color developing agent, but since the oxidized product is in itself unstable, it tends to lose its reaction activity prior to its coupling reaction with the coupler, and as a result the dye forming efficiency is considered to be lowered. The foregoing oxidized product of a color developing agent itself or a product changed therefrom is known to bleach the latent image of a silver halide and is considered also a cause of lowering the dye forming efficiency to the latent image. From the above facts it is understood that further increasing the reaction rate of such two-equivalent couplers enables the realization of higher photographic speed, economization of silver and more reduction of the layer thickness of photographic materials on a higher level.

It is also known that those naphthol-type two-equivalent cyan couplers produce more fog than do four-equivalent couplers and tend to cause a stain or fog trouble during the storage of raw photographic materials and to deteriorate the color formability, thus resulting in the deterioration of color reproducibility, which imposes restrictions on the designing of photographic materials.

SUMMARY OF THE INVENTION

It is therefore a first object of this invention to provide a high-speed silver halide photographic material by use of a novel two-equivalent cyan coupler having a high color-forming efficiency.

It is a second object of this invention to provide a silver halide photographic material whose using amount of silver is reduced by use of the afore-mentioned cyan coupler.

It is a third object of this invention to provide a silver halide photographic material whose emulsion layer's thickness is reduced by use of the foregoing cyan coupler.

It is a fourth object of this invention to provide a silver halide photographic material which is improved on the color reproducibility by use of a novel two-equivalent cyan coupler which hardly produces a fog on a photographic material and which is capable of improving the preservability of a raw photographic material.

The above objects of the present invention are accomplished by providing a silver halide photographic material comprising at least one of those cyan couplers having the following general formula:

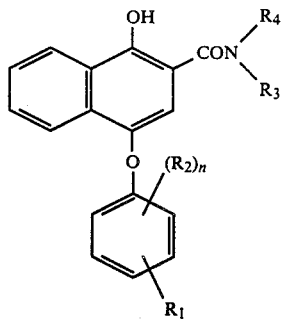

wherein $R_1$ is an acylamino, alkylsulfonamido, arylsulfonamido, carbamoyl, sulfamoyl, alkylureido, arylureido, alkyl, alkoxy, amino, alkoxycarbonyl or aryloxycarbonyl group, and each of these groups is substituted by at least one carboxyl group; $R_2$ is a hydrogen atom, a halogen atom, an alkyl, alkoxy, nitro, cyano, formyl, carboxyl, hydroxyl, amino, acylamino, alkylsulfonamido, arylsulfonamido, alkylureido, arylureido, sulfamoyl, carbamoyl, alkoxycarbonyl or aryloxycarbonyl group; $R_3$ is an alkyl or aryl group; $R_4$ is a hydrogen atom or an alkyl group; and n is an integer of 1 through 4, provided that, when n is equal to or more than 2, the $R_2$s are allowed to be either the same as or different from each other, and also provided that the sum of the carbon atoms of $R_3$ and $R_4$ is equal to or more than 10.

DETAILED DESCRIPTION OF THE INVENTION

In the coupler of the invention having the foregoing Formula, $R_1$ is one of the following groups substituted by at least one carboxyl group: an acylamino group (such as methaneamido, ethaneamido, propaneamido, butaneamido, hexaneamido, octaneamido, dodecaneamido, benzamido, etc.), alkylsulfonamido group (such as methanesulfonamido, ethanesulfonamido, propanesulfonamido, hexanesulfonamido, octanesulfonamido, dodecanesulfonamido, etc.), arylsulfonamido group (such as benzenesulfonamido, naphthalenesulfonamido, etc.), carbamoyl group (such as methylcarbamoyl, ethylcarbamoyl, propylcarbamoyl, dodecylcarbamoyl, phenylcarbamoyl, etc.), sulfamoyl group (such as N-methylsulfamoyl, N-ethylsulfamoyl, N-butylsulfamoyl, N-octylsulfamoyl, N,N-dimethylsulfamoyl, phenylsulfamoyl, etc.), alkylureido group (such as methylureido, ethylureido, etc.), arylureido group (such as phenylureido, naphthylureido, etc.), alkyl group (such as methyl, ethyl, propyl, octyl, dodecyl, etc.), alkoxy group (such as methoxy, ethoxy, propyloxy, butyloxy, octyloxy, dodecyloxy, etc.), amino group (such as methylamino, ethylamino, propylamino, butylamino, octylamino, dodecylamino, dimethylamino, diethylamino, anilino, etc.), alkoxycarbonyl group (such as methoxycarbonyl, ethoxycarbonyl, butoxycarbonyl, octyloxycarbonyl, dodecyloxycarbonyl, etc.), and aryloxycarbonyl group (such as phenoxy carbonyl, etc.). The particularly preferred among these groups are acylamino, alkylsulfonamido and arylsulfonamido groups.

Each of the above groups may have a substituent. If substituted by a substituent, the foregoing at least one carboxyl group may be introduced to the substituent. The preferred examples of the substituent include a halogen atom (such as fluorine, chlorine, bromine), hydroxyl group, nitro group, cyano group, alkyl group (such as methyl, ethyl, propyl, iso-propyl, butyl, iso-butyl, sec-butyl, tert-butyl, pentyl, iso-pentyl, sec-pentyl, tert-pentyl, hexyl, heptyl, octyl, nonyl, decyl, dodecyl, iso-dodecyl, cetyl, etc.), cyanoalkyl group (such as cyanomethyl, etc.), fluorinated alkyl group (such as trifluoromethyl, octafluorobutyl, etc.), aryl group (such as phenyl, naphthyl, etc.), alkoxy group (such as methoxy, ethoxy, propyloxy, iso-propyloxy, butoxy, iso-butoxy, sec-butoxy, tert-butoxy, pentyloxy, iso-pentyloxy, tert-pentyloxy, dodecyloxy, etc.), aryloxy group (such as phenoxy, tolyloxy, etc.), carboxyl group, alkyloxycarbonyl group (such as ethoxycarbonyl, dodecyloxycarbonyl, etc.), aryloxycarbonyl group (such as phenoxycarbonyl, etc.), alkylacyloxy group (such as acetyloxy, cyclohexylcarbonyloxy, etc.), arylacyloxy group (such as benzoyloxy, etc.), alkylamino group (such as ethylamino, dimethylamino, diethanolamino, dodecylamino, hexadecylamino, etc.), arylamino group (such as anilino, naphthylamino, etc.), alkylcarbamoyl group (such as ethylcarbamoyl, carboxyethylcarbamoyl, dodecylcarbamoyl, etc.), arylcarbamoyl group (such as phenylcarbamoyl, etc.), acylamino group (such as methaneamido, dodecaneamido, hexadecaneamido, benzamido, etc.), acyl group (such as benzoyl, pentafluorobenzoyl, ethylcarbonyl, propylcarbonyl, etc.), alkylthio group (such as methylthio, propylthio, octylthio, dodecylthio, etc.), alkylsulfonyl group (such as methylsulfonyl, ethylsulfonyl, octylsulfonyl, decylsulfonyl, dodecylsulfonyl, etc.), alkylsulfamoyl group (such as ethylsulfamoyl, pentylsulfamoyl, dodecylsulfamoyl, N-methylsulfamoyl, N,N-dimethylsulfamoyl, etc.), alkylsulfonamido group (such as methylsulfonamido, ethylsulfonamido, dodecylsulfonamido, p-dodecylphenylsulfonamido, etc.), arylsulfonamido group (such as phenylsulfonamido, etc.), and the like.

$R_2$ represents any one of the following atoms or groups: a hydrogen atom, halogen atom (such as fluorine, chlorine, bromine), alkyl group (such as methyl, ethyl, propyl, octyl, dodecyl, etc.), alkoxy group (such as methoxy, ethoxy, propyloxy, butyloxy, octyloxy, dodecyloxy, etc.), nitro group, cyano group, formyl group, carboxyl group, hydroxyl group, amino group (such as methylamino, ethylamino, propylamino, butylamino, octylamino, dodecylamino, dimethylamino, diethylamino, anilino, etc.), acylamino group (such as methaneamido, ethaneamido, propaneamido, butaneamido, hexaneamido, octaneamido, dodecaneamido, benzamido, etc.), alkylsulfonamido group (such as methanesulfonamido, ethanesulfonamido, propanesulfonamido, hexanesulfonamido, octanesulfonamido, dodecanesulfonamido, etc.), arylsulfonamido group (such as benzenesulfonamido, naphthalenesulfonamido, etc.), alkylureido group (such as methylureido, ethylunreido, etc.), arylureido group (such as phenylureido, naphthylureido, etc.), sulfamoyl group (such as N-methylsulfamoyl, N-ethylsulfamoyl, N-butylsulfamoyl, N-octylsulfamoyl, N,N-dimethylsulfamoyl, phenylsulfamoyl, etc.), carbamoyl group (such as methylcarbamoyl, ethylcarbamoyl, propylcarbamoyl, dodecylcarbamoyl, phenylcarbamoyl, etc.), alkoxycarbamoyl group (such as methoxycarbonyl, ethoxycarbonyl, butoxycarbonyl, octyloxycarbonyl, dodecyloxycarbonyl, etc.), and aryloxycarbonyl group (such as phenoxycarbonyl, etc.). $R_2$ is preferably a hydrogen atom, a halogen atom, a nitro, acylamino, alkylsulfonamido, or arylsulfonamido group, and more preferably a hydrogen atom, an acylamino, alkylsulfonamido or arylsulfonamido group. Each of these groups represented by $R_2$ may have a substituent. The preferred examples of the substituent include the foregoing same substituents as defined in $R_1$.

$R_3$ represents an alkyl group (such as methyl, ethyl, propyl, butyl, amyl, octyl, dodecyl, etc.) or an aryl group (such as phenyl, naphthyl, etc.). Each of these groups represented by $R_3$ may have a substituent. The preferred examples of the substituent include the substituents as previously defined in $R_1$. $R_3$ is preferably an alkyl group, and more preferably a phenoxy-substituted alkyl group.

$R_4$ represents a hydrogen atom or an alkyl group (such as methyl, ethyl, propyl, butyl, amyl, octyl, dodecyl, etc.). The alkyl group represented by $R_4$ may have a substituent. The preferred examples of the substituent include the substituents as previously defined in $R_1$. $R_4$ is preferably a hydrogen atom. Provided, however, that the total number of the carbon atoms of $R_3$ and $R_4$ including substituents is equal to or more than 10.

The following are examples of those cyan couplers having the foregoing Formula. The present invention is not limited to and by the following examples.

(1)

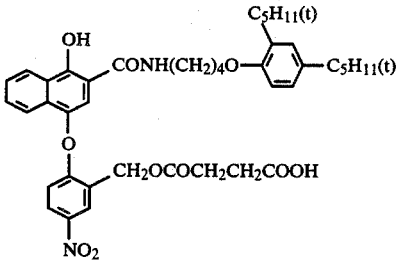

(2)

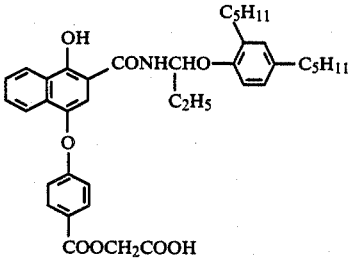

(3)

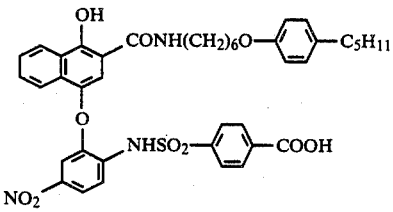

(4)

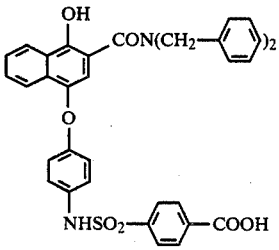

-continued (5)

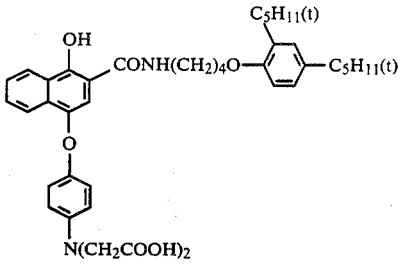

(6)

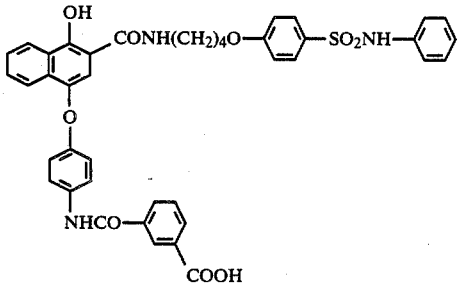

(7)

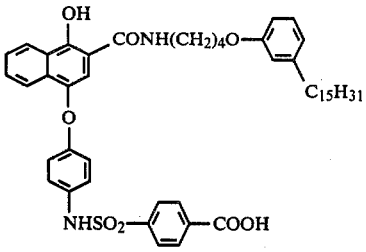

(8)

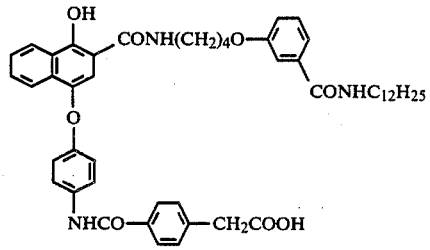

(9)

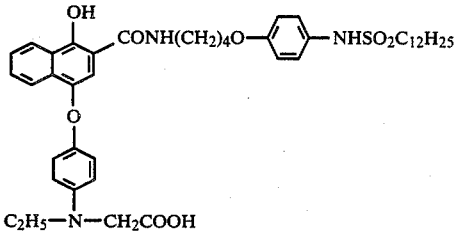

(10)

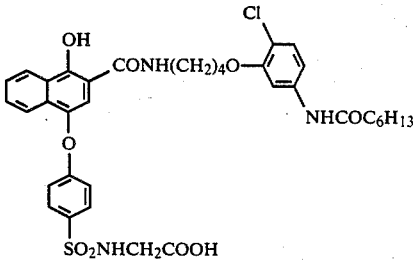

-continued
(11)
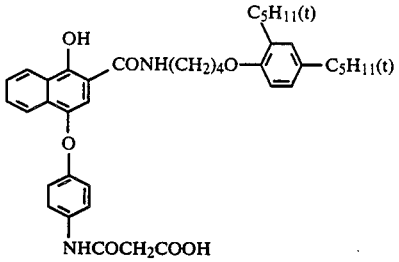
(12)
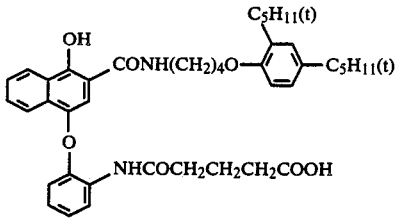
(13)
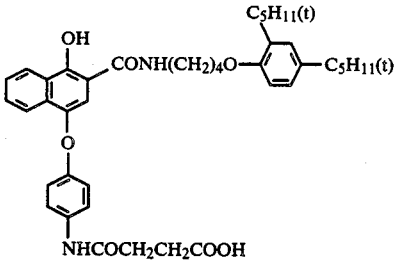
(14)
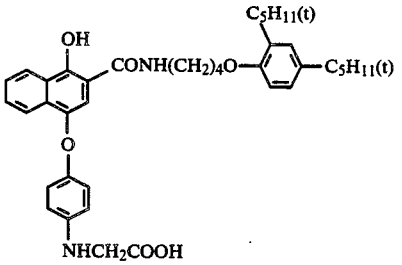
(15)
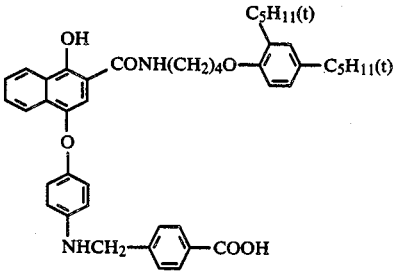
(16)
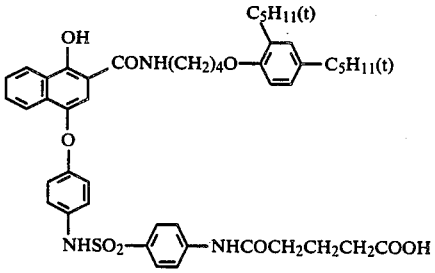
-continued
(17)
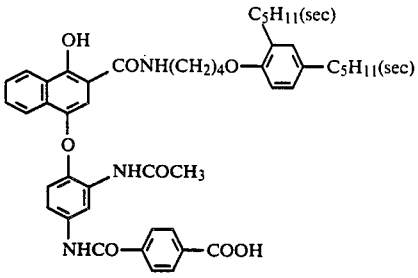
(18)
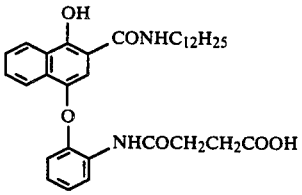
(19)
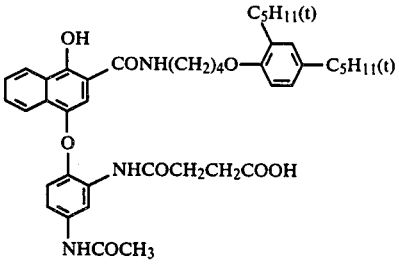
(20)
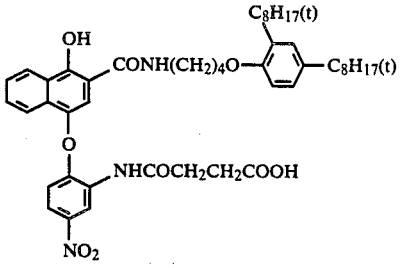
(21)
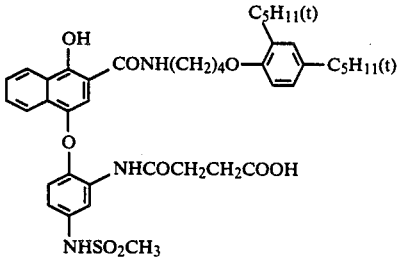
(22)
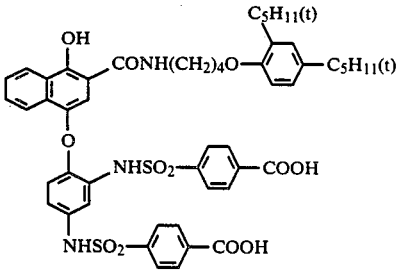

-continued
(23)
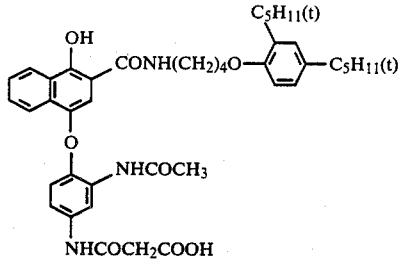
(24)
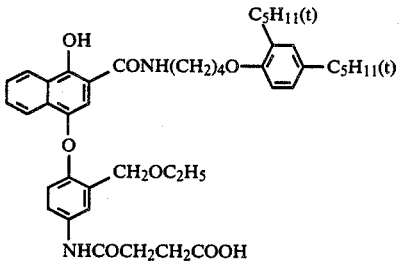
(25)
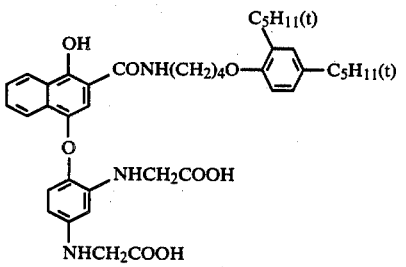
(26)
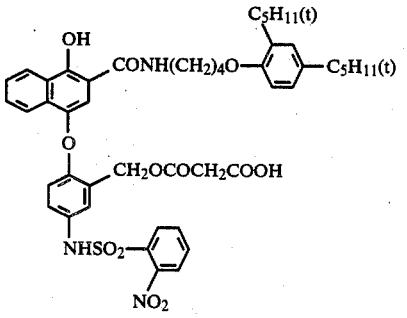
(27)
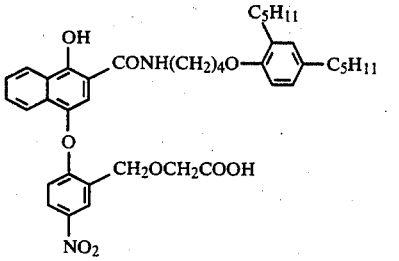
-continued
(28)
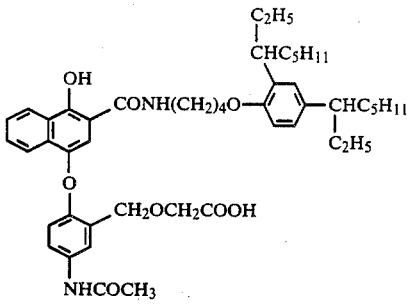
(29)
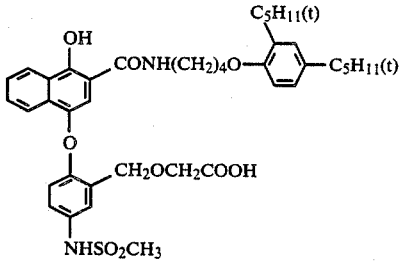
(30)
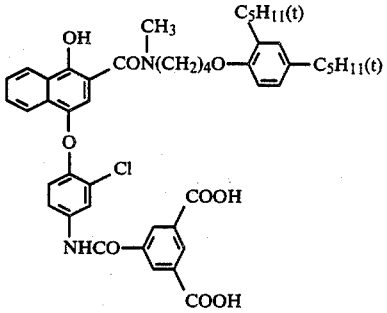
(31)
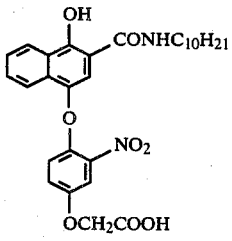
(32)
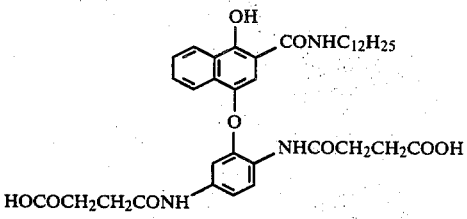
(33)
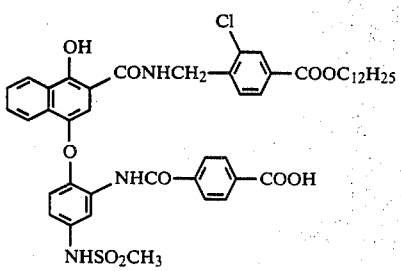

-continued
(34)
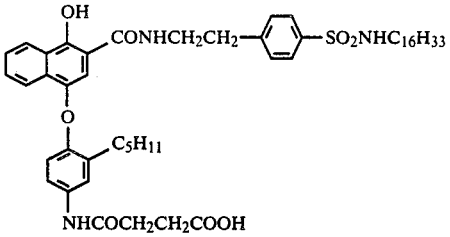
(35)
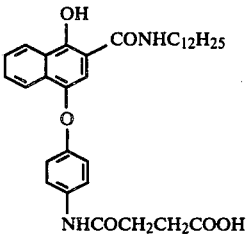
(36)
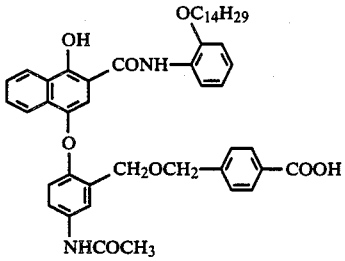
(37)
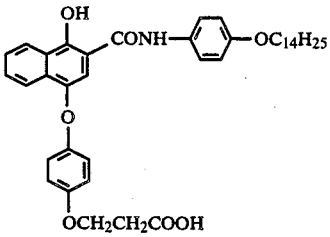
(38)
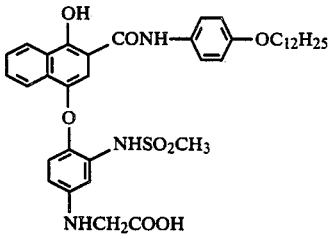
(39)
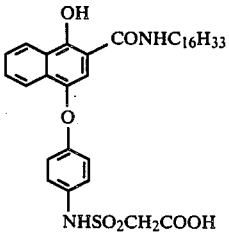
-continued
(40)
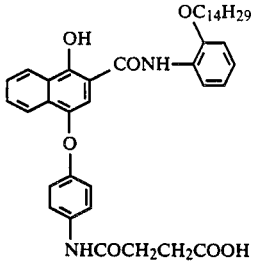
(41)
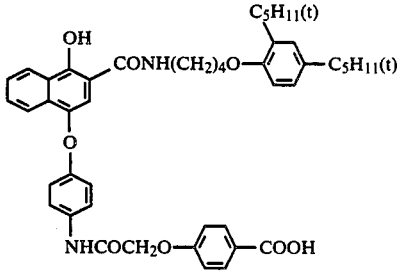
(42)
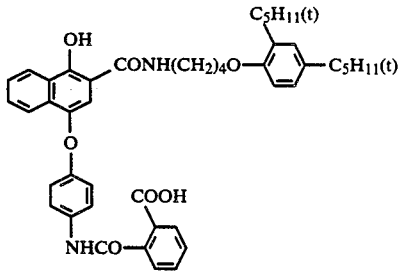
(43)
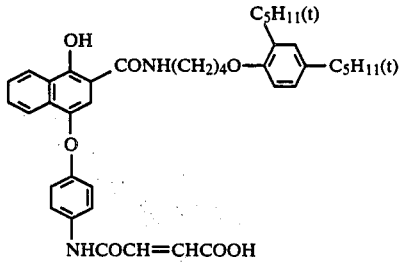
(44)
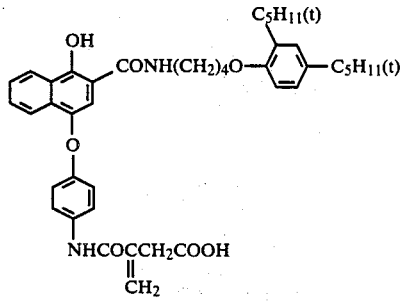

-continued (45)

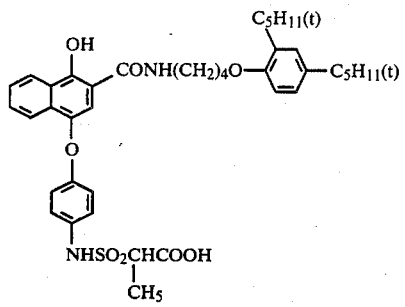

(46)

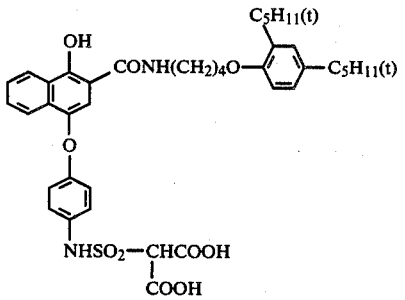

(47)

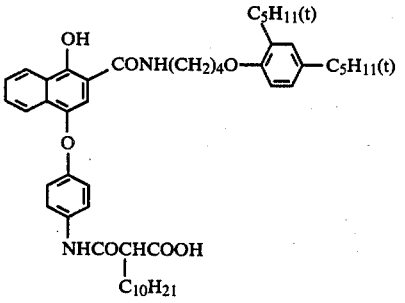

(48)

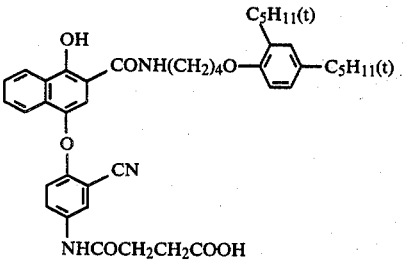

(49)

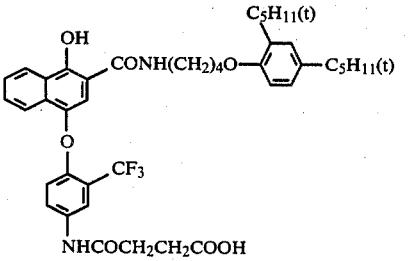

-continued (50)

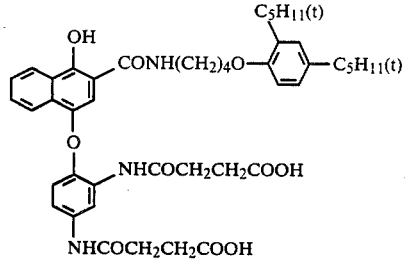

(51)

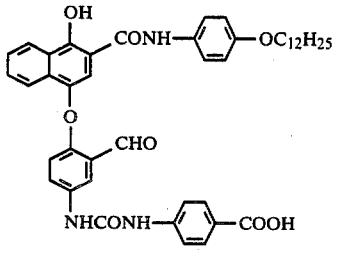

(52)

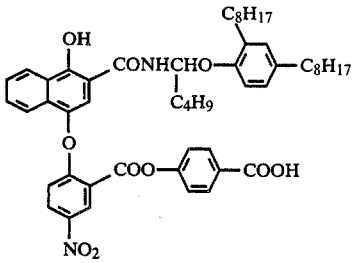

Any of these naphthol-type two-equivalent cyan couplers of this invention may be easily synthesized in accordance with synthesis methods of the prior art such as those synthesis methods described in the previously mentioned patent specifications relating to naphthol-type two-equivalent cyan couplers.

Some of general synthesis methods from intermediates will be briefed along reaction schemes below:

Reaction Schemes (a)

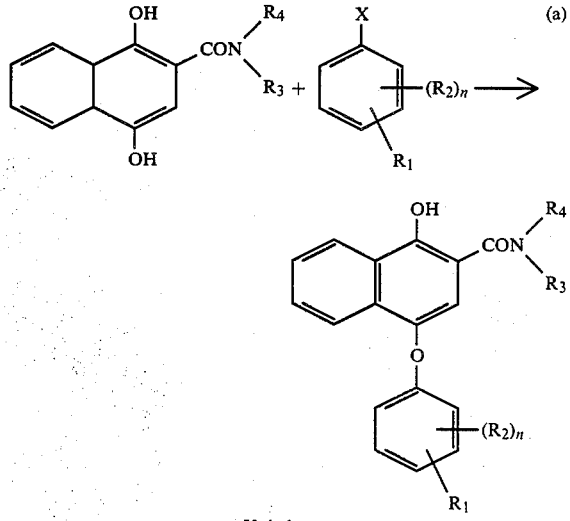

X: halogen

-continued (b)

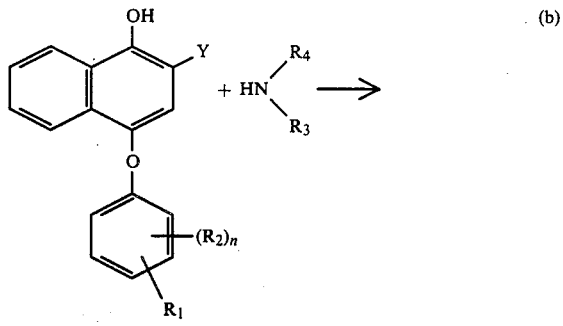

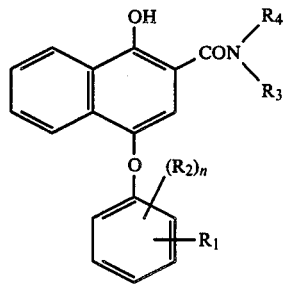

Y: —COOH, —COCl, —COO— etc.

(c)

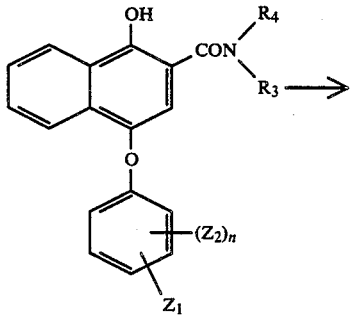

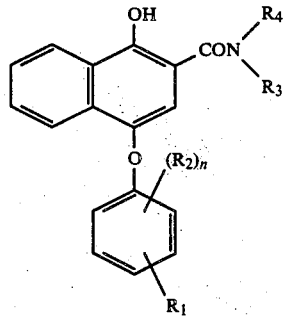

$Z_1$, $Z_2$: reactive groups

Either one of $Z_1$ and $Z_2$ may be either $R_1$ or $R_2$.

(d)

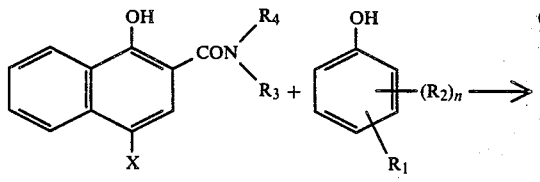

-continued

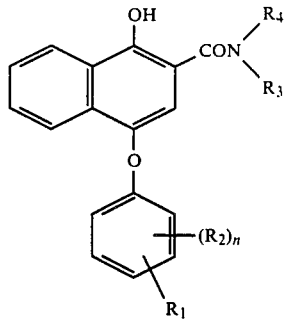

X: halogen (e)

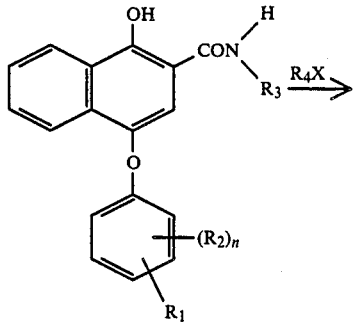

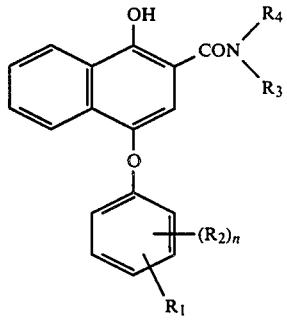

Reaction (a) is the reaction between dihydroxynaphthoamido and a halogenated benzene. The reaction usually takes place in the presence of a basic catalyst.

Reaction (b) is the reaction of naphthoic acid, an acid chloride or an active ester with an amine. In the case of naphthoic acid, the reaction takes place usually in the presence of a dehydrating catalyst such as N,N-dicyclohexylcarbodiimide, p-toluenesulfonic acid, sulfuric acid, and the like. In the reaction with acid chloride, an organic base such as pyridine, triethylamine, etc., or an inorganic base such as potassium carbonate, caustic soda, etc., is used as a catalyst. Alternatively the reaction may take place expelling hydrochloric acid under reflux by heating. In the reaction between an acitive ester and amine, a phenyl ester is generally used, if necessary, with a basic catalyst.

Reaction (c) is a synthesis method in which, when the halogenated benzene in Reaction (a) is not adequately reactive, in order to raise the reactivity an electron-attractive group such as a nitro, cyano, or formyl group is introduced thereto, and a phenoxy group is introduced to the reaction active site, and after that an objective coupler is obtained through one or more reactions. For example, in Synthesis Example 1 which will be described hereinafter. Reaction (c) takes place using as a material an amino compound obtained by hydrating the product of the reaction in usual manner between a four-equivalent naphthol coupler and p-nitrofluorobenzene. The same shall apply to Synthesis Example 2.

Reaction (d) is basically the same as Reaction (a) and is the reaction between 1-hydroxynaphthoamide having a halogen in the fourth position thereof and a phenol derivative. Similarly to Reaction (a), it is desirable to use a basic catalyst.

Reaction (e) is an example wherein $R_4$ is not a hydrogen atom but an alkyl group and is the reaction between a secondary amine and a halogenated alkyl, in which, if necessary, a catalyst such as aluminum chloride, zinc chloride or basic catalyst may be used.

The above Reactions (a) through (e) are for the final process. The intermediates prior to the final process may also be easily synthesized by similar methods to the above.

Generally, Reactions (a), (b) and (c) are mostly used. Examples of the synthesis will be illustrated in detail below:

SYNTHESIS EXAMPLE 1

{Synthesis of Exemplified Compound (13)}

Thirty grams of 1-hydroxy-4-(4-amino)phenoxy-N-{4-(2,4-di-tert-pentylphenoxy)butyl}-2-naphthoamide were dissolved into 200 ml of ethyl acetate, and to the solution were added dropwise at room temperature a solution of 20 g of succinic anhydride dissolved into 100 ml of ethyl acetate. After the dropwise addition the mixture was refluxed by heating for two hours and the solvent was then distilled off under reduced pressure. And then the reaction product was recrystallized from a mixed solvent of ethyl acetate and ligroin, whereby 25 g of objective white crystals were obtained. The product was ascertained to be an object from the m.p. being 153° to 154° C., and FD-Mass $M^+=682$.

SYNTHESIS EXAMPLE 2

{Synthesis of Exemplified Compound (50)}

Thirty grams of 1-hydroxy-4-(2,4-diamino)phenoxy-N-{4-di-tert-pentylphenoxy)butyl}-2-naphthoamido were dissolved into 200 ml of ethyl acetate, and to the solution with stirring were added 40 mg of succinic anhydride, and the mixture was refluxed by heating for two hours. After the solvent was distilled off under reduced pressure the product was recrystallized from alcohol, whereby 31 g of objective white crystals were obtained. The product was ascertained to be an object from the m.p. being 105° to 107° C. and FD-Mass $M^+=797$.

The foregoing exemplified naphthol-type cyan couplers of the present invention other than the above may also be easily synthesized in similar manner to the above synthesis examples.

These naphthol-type cyan couplers of the present invention, although desirable to be used alone, may be used in combination of two or more. The naphthol-type cyan coupler of this invention may also be used in combination with one or two or more of those naphthol-type and phenol-type cyan couplers outside this invention. (Where two or mre naphthol-type cyan couplers of this invention are used in combination, a certain one of the naphthol-type cyan couplers will hereinafter be called 'main coupler' and the other naphthol-type cyan coupler(s) of this invention will be called 'subcoupler.')

The using amount of the naphthol-type cyan coupler of this invention, although not definite, if used alone, is preferably from $1\times10^{-4}$ to 10 moles, and more preferably from 0.01 to 0.5 mole per mole of silver halide. On the other hand, if it is used in combination with other couplers, the subcoupler of this invention or other non-invention naphthol-type and phenol-type cyan couplers should be used in an amount of from $1\times10^{-3}$ to 100 moles per mole of the main coupler of this invention.

Referring in detail to the method of incorporating the naphthol-type cyan coupler of this invention into the silver halide emulsion of this invention, the naphthol-type cyan coupler of this invention, if alkali-soluble, may be added in the form of an alkaline solution, and if oil-soluble, is desirable to be dissolved into a high-boiling organic solvent, if necessary, in combination with a low-boiling organic solvent, and then dispersed in the particulate form into the silver halide emulsion in accordance with those methods as described in, e.g., U.S. Pat. Nos. 2,322,027, 2,801,170, 2,801,171, 2,272,191 ans 2,304,940. Examples of hydrophilic colloid to be used as the binder for the emulsion include gelatin and gelatin derivatives known as the photographic binder, graft polymers of gelatin, various cellulose derivatives, partially oxidized product of polyvinyl alcohol, sodium alginate, poly-N-vinylpyrolidone, and the like, which may be diversely usable. In this instance, if necessary, additives such as hydroquinone derivatives, ultraviolet absorbing agents, antidiscoloration agents, and the like, may be used in combination. And two or more of the naphthol-type cyan couplers of this invention may also be used mixing with these additives.

Aside from the above, those methods using latex dispersion or other polymers are also known.

Further, referring more in detail to the preferred method for incorporating the naphthol-type cyan coupler of this invention into the silver halide emulsion, the method is such that one or two or more naphthol-type cyan couplers of this invention, if necessary, in combination with other couplers, hydroquinone derivatives, antidiscoloration agents, ultraviolet absorbing agents, etc., are dissolved into a high-boiling organic solvent such as an organic acid amide, a carbamate, an ester, a ketone, an urea derivative, an ether, a hydrocarbon, or the like; particularly, di-n-butyl phthalate, tricresyl phosphate, triphenyl phosphate, di-iso-octyl azelate, di-n-butyl sebacate, tri-n-hexyl phosphate, N,N-diethyl-caprylamidobutyl, N,N-diethyl-laurylamide, n-pentadecylphenyl ether, di-n-octyl phthalate, di-iso-dodecyl phthalate, di-n-nonyl phthalate, 2,4-di-tert-phentyl-phenol, n-nonyl-phenol, 3-pentadecyl-phenyl-ethyl ether, 2,5-di-sec-amyl-phenyl-butyl ether, monophenyl-di-o-chlorophenyl phosphate, fluorinated paraffin, or the like, and/or a low-boiling organic solvent such as methyl acetate, ethyl acetate, propyl acetate, butyl acetate, butyl propionate, cyclohexanol, diethylene glycol monoacetate, nitromethane, carbon tetrachloride, chloroform, cyclohexane-tetrahydrofuran, methyl alcohol, acetonitrile, dimethyl formamide, dioxane, methyl-ethyl ketone, or the like, and the resulting solution is mixed with an aqueous solution containing an anionic surfactant such as an alkylbenzenesulfonic acid, alkylnaphthalenesulfonic acid, or the like, and/or a nonionic surfactant such as a sorbitansesquioleic acid ester, sorbitanmonolauric acid ester, or the like, and/or a cationic surfactant, and/or a hydrophilic binder such as gelatin, and then the mixture is emulsifiedly dispersed by means of a high-speed rotary mixer, colloid mill, ultrasonic disperser, or the like, and the dispersed liquid is then added to a silver halide emulsion.

In addition, the above latex dispersion method and the effect thereof are described in Japanese Patent O.P.I. Publication Nos. 74538/1974, 59943/1976, 32552/1979, and Research Disclosure August 1976, No. 14850, p. 77~79.

Suitable examples of the latex include those homopolymers, copolymers and terpolymers comprising such monomers as, for example, styrene, acrylates, n-butyl acrylate, n-butyl methacrylate, 2-acetacetoxyethyl methacrylate, 2-(methacryloyloxy)ethyl-trimethylammonium methosulfate, sodium 3-(methacryloyloxy)-propane-1-sulfonate, N-isopropylacrylamide, N-[2-methyl-4-oxopentyl)]acrylamide, 2-acrylamido-2-methylpropanesulfonic acid, or the like.

The naphthol-type cyan coupler of this invention is generally incorporated into a silver halide emulsion layer, but the emulsion layer, if necessary, may be divided into two or more emulsion layers such as a high-speed emulsion layer, medium-speed emulsion layer, and low-speed emulsion layer. In this instance, the coupler may be incorporated into (an) arbitrary emulsion layer(s). And, if necessary, the coupler may be incorporated into a non-emulsion layer adjacent to the red-sensitive silver halide emulsion layer, but most preferably should be incorporated into the highest-speed emulsion layer.

For the method of processing the silver halide photographic material of this invention, for example, a color developing bath containing a color developing agent may be used. And in addition to the bath processing, various other processing methods may also be used; for example, the spray method which sprays a processing solution, the web method which uses a processing solution-impregnated carrier for contact-processing, the processing method of using a viscous processing solution, and the like.

No particular restrictions are imposed on the method of processing the silver halide photographic material of this invention; every possible processing method can be used. Those representative of the processing method include, for example, a method comprising color developing, bleach-fix, if necessary, washing and/or stabilizing; a method comprising color developing, bleaching and fixing separately made, if necessary, washing and/or stabilizing; a method comprising prehardening, neutralizing, color developing, stop-fixing, washing, bleaching, fixing, washing, post-hardening, and washing; a method comprising color developing, washing, supplementary color developing, stopping, bleaching, fixing, washing, and stabilizing; a developing method in which the developed silver produced by color development is halogenation-bleached, and then color-developed again to thereby increase the amount of the produced dye; the reversal processing method; and the like. Any of these methods may be used.

The foregoing color developer solution, which may be for use in the processing of the silver halide photographic material of this invention, is an aqueous alkaline solution containing a color developing agent, whose pH is preferably equal to or more than 8, and more preferably from 9 to 12. Aromatic primary amine-type color developing agents to be used as the color developing agent are compounds having a primary amino group on an aromatic ring and capable of developing an exposed silver halide. The color developer solution, if necessary, may be allowed to contain additionally a precursor that forms such a compound.

Those representative of the above color developing agent are p-phenylenediamine-type compounds, the preferred examples of which include 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methoxyethylaniline, 3-methyl-4-amino-N-ethyl-N-β-methanesulfonamidoethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-dimethylaniline, N-ethyl-N-β-[β-(β-methoxyethoxy)ethoxy]ethyl-3-methyl-4-aminoaniline, N-ethyl-N-β-(β-methoxyethoxy)ethyl-3-methyl-4-aminoaniline, and salts of these compounds, such as those sulfates, hydrochlorides, sulfites, p-toluenesulfonates, and the like.

Further, they also include those as representative ones described in, e.g., Japanese Patent O.P.I. Publication Nos. 64932/1973, 131526/1975, 95849/1976, and Bent et al, the Journal of the American Chemical Society, Vol. 73, Nos. 3100~3125 (1951).

The using amount of these aromatic primary amino compounds, although it depends on to what extent the activity of a developer solution should be settled, is desirable to be increased in order to raise the activity. The compound is used in the quantity range of from 0.0002 mole per liter to 0.7 mole per liter. As the case may be, two or more of such compounds may be used in arbitrary combination. The color developing agent may be in the form of a precursor, and in that case, it may be incorporated into the photographic material of this invention.

The color developer solution used in this invention may arbitrarily contain further various components usually added to a color developer solution, including alkali agents such as sodium hydroxide, sodium carbonate, etc., sulfite of an alkali metal, hydrogensulfite of an alkali metal, thiocyanate of an alkali metal, halide of an alkali metal, benzyl alcohol, water softener, thickener, and development accelerator, and the like.

Additives other than the above ones to be added to the foregoing color developer solution include compounds for use in rapid development, including bromides such as potassium bromide, ammonium bromide, etc., potassium iodide, nitrobenzimidazole, mercaptobenzimidazole, 5-methyl-benzotriazole, 1-phenyl-5-mercaptotetrazole, and the like; antistain agents; antisludge agents; preservatives; interimage effect accelerators; chelating agents; and the like.

As the bleaching agent to be used in a bleaching solution in the bleaching process or in a bleach-fix bath those compounds in which an organic acid, such as an aminopolycarboxylic acid, oxalic acid, citric acid, etc., is coordinated with a metallic ion such as of iron, cobalt, copper, etc., are generally known. And representative examples of the above aminopolycarboxylic acid include ethylenediamine-tetraacetic acid, diethylenetriamin-pentaacetic acid, propylenediamine-tetraacetic acid, nitrilotriacetic acid, iminodiacetic acid, ethylletherdiamine-tetraacetic acid, ethylenediamine-tetrapropionic acid, disodium ethylenediamine-tetraacetate, pentasodium diethylenetriamine-pentaacetate, and sodium nitrilotriacetate.

The bleaching solution may contain various additives along with the above bleaching agent. Where a bleach-fix bath is used in the bleaching process, a liquid of a composition containing a silver halide fixing agent in addition to the aforementioned bleaching agent is used. The foregoing bleach-fix bath may be allowed to additionally contain a halide such as, for example, potassium bromide, and, similarly to the bleaching solution, may also contain various additives such as, e.g., a pH buffer, brightening agent, defoaming agent, surfactant, preservative, chelating agent, stabilizer, organic solvent, and the like.

In addition, examples of the silver halide fixing agent include, e.g., those compounds reacting with a silver halide to form a water-soluble silver salt, which are usually used in the fixing process, such as, e.g., sodium thiosulfate, ammonium thiosulfate, potassium thiocyanate, sodium thiocyanate, thiourea, thioether, and the like.

Various developing processes of the silver halide photographic material of this invention, such as color developing, bleach-fix (or bleaching and fixing), and, if necessary, washing, stabilizing, and drying, are desirable to take place at a temperature of not less than 30° C. from the standpoint of rapid processing.

The silver halide photographic material of this invention may be subjected to any of those stabilizing treatments substituted for washing as described in Japanese Patent O.P.I. Publication Nos. 14834/1983, 105145/1983, 134634/1983 and 18631/1983, and Japanese Patent Application Nos. 2709/1983 and 89288/1984.

The photographic component layers of the silver halide photographic material of this invention may contain a water-soluble or decolorizable-in-color-developer-solution dye (AI dye). Examples of the AI dye include oxonole dyes, hemioxonole dyes, merocyanine dyes and azo dyes. Of these, the oxonole dyes, hemioxonole dyes and merocyanine dyes are useful. Usable examples of the AI dye include those as described in British Pat. Nos. 584,609 and 1,277,429, Japanese Patent O.P.I. Publication Nos. 8530/1973, 99620/1974, 114420/1974, 129537/1974, 108115/1977, 25845/1984, 111640/1984 and 11641/1984, U.S. Pat. Nos. 2,274,782, 2,533,472, 2,956,879, 3,125,448, 3,148,187, 3,177,078, 3,247,127, 3,260,601, 3,540,887, 3,575,704, 3,653,905, 3,718,472, 4,071,312 and 4,070,352.

The using amount of any of these AI dyes in an emulsion layer is preferably from $2\times10^{-3}$ to $5\times10^{-1}$ moles per mole of silver, and more preferably from $1\times10^{-2}$ to $1\times10^{-1}$.

The amount of silver (coating amount of silver per unit area) in a silver halide emulsion layer of the silver halide color photographic material of this invention, although not definitive, is desirable to be from 2 to 20 g/m$^2$ in the whole light-sensitive silver halide emulsion layers. That is, in order to obtain an excellent image quality, the amount of silver is desirable to be equal to or less than 12 g/m$^2$, while in order to obtain a higher maximum density and higher sensitivity, the amount of silver is desirable to be equal to or more than 5 g/m$^2$.

The silver halide composition suitable usable in this invention is silver iodobromide, silver bromide, silver chloride, silver chlorobromide, silver chloroiodobromide, or the like.

The crystal of these silver halide grains may be regular, twin or else of other forms, and any of those silver halides whose crystal is of an arbitrary {100} face-{111} face proportion may be used. Further, the crystal of these silver halide grains may be of either homogeneous structure from the inside through outside or heterogeneous structure stratified with the inside and outside (core-shell type). In addition, these silver halides may be of either the type of forming a latent image mainly on the grain surface or the type of forming a latent image inside the grain. Besides, plate-form silver halide grains (Japanese Patent O.P.I. Publication No. 113934/1983, Japanese Patent Application No. 170070/1984) may also be used.

These silver halide grains particularly suitably usable in this invention are substantially monodisperse, and may be ones prepared by any of the acid method, neutral method, ammoniacal method or the like.

Alternatively, these grains may also be ones prepared in the manner that, for example, seed crystals are first prepared by the acid method, and are then grown by the ammoniacal method capable of growing faster the seed crystal, thereby being grown up to a specified size. In the case of growing the silver halide grains, it is desirable, for example, as described in Japanese Patent O.P.I. Publication No. 48521/1979, to sequentially simultaneously pour silver and halide ions in quantities meeting the growth rate of silver halide grains with the pH, pAg, etc., inside the reactor being controlled.

The preparation of the silver halide grains used in this invention is desirable to be made as described above. A composition containing the silver halide grains is herein referred to as 'silver halide emulsion.'

The silver halide emulsion may be chemically sensitized by using active gelatin; a sulfur sensitizers such as an arylthiocarbamide, thiourea, cystine, etc.; a selenium sensitizer; a reduction sensitizer such as a stannous salt, thiourea dioxide, polyamine, etc.; noble-metallic sensitizer such as a gold sensitizer, e.g., potassium aurothiocyanate, potassium chloroaurate, 2-aurothio-3-methylbenzothiazolium chloride, or a water-soluble salt of a noble metal such as, e.g., ruthenium, palladium, platinum, rhodium, iridium, etc., to be more concrete, ammonium chloropalladate, potassium chloroplatinate, and sodium chloropalladate (some of these act as either sensitizers or antifoggants depending on the quantity used); or the like. These sensitizers may be used alone or in arbitrary combination (for example, in combination of a gold sensitizer and sulfur sensitizer, in combination of a gold sensitizer and selenium sensitizer) for the chemical sensitization.

The silver halide emulsion used in this invention may be chemically ripened with the addition of a sulfur-containing compound, and into the emulsion, prior to, during or after the ripening may be incorporated at least one hydroxytetrazaindene and at least one mercapto group-having nitrogen-containing heterocyclic compound.

The silver halide used in this invention, in order to be made sensitive to desired wavelength regions, may be optically sensitized by the addition thereto of appropriate sensitizing dyes in the quantity range of from $5\times10^{-8}$ to 1 mole per mole of silver halide. Various compounds may be used as the sensitizing dye, and various sensitizing dyes may be used alone or in combination of two or more. Those advantageously usable sensitizing dyes in this invention include, for example, the following:

That is, sensitizing dyes usable in the blue-sensitive silver halide emulsion layer include those as described in, e.g., West German Pat. No. 929,080, U.S. Pat. Nos. 2,231,658, 2,493,748, 2,503,776, 2,519,001, 2,912,329, 3,656,959, 3,627,897, 3,694,217, 4,025,349 and 4,046,572, British Pat. No. 1,242,588, and Japanese Patent Examined Publication Nos. 14030/1969 and 24844/1977. Representative sensitizing dyes usable for the green-sensitive silver halide emulsion include those cyanine dyes, merocyanine dyes or complex cyanine dyes as described in, e.g., U.S. Pat. Nos. 1,939,201, 2,072,908, 2,739,149 and 2,945,763, and British Pat. No. 505,979. Further, representative sensitizing dyes usable for the red-sensitive silver halide emulsion include those cyanine dyes, merocyanine dyes or complex cyanine dyes as described in, e.g., U.S. Pat. Nos. 2,269,234, 2,270,378, 2,442,710, 2,454,629 and 2,776,280. Further, those cyanine dyes, merocyanine dyes or complex cyanine dyes as described in U.S. Pat. Nos. 2,213,995, 2,433,748 and 2,519,001, and West German Pat. No. 929,080, and the like, may be advantageously used for the green-sensitive silver halide emulsion or red-sensitive silver halide emulsion.

These sensitizing dyes may be used alone or in combination.

The silver halide photographic material of this invention may, if necessary, be optically sensitized to desired wavelength regions by the spectral sensitization method using cyanine or merocyanine dyes.

Particularly suitable, representative spectral sensitization methods include those as described in, e.g., Japanese Patent Examined Publication Nos. 4936/1968, 22884/1868, 18433/1970, 37443/1972, 28293/1973, 6209/1974, 12375/1978, 23931/1977, 51932/1977, 80118/1979, 153926/1983, 116646/1984, 116647/1984, and the like, relating to the combination of benzimidazolocarbocyanine and benzoxazolocarbocyanine.

Further, descriptions concerning the combination of carbocyanines having a benzimidazole nucleus with other cyanines or merocyanines are found in, e.g., Japanese Pat. Nos. 25831/1970, 11114/1972, 25379/1972, 38406/1973, 38407/1973, 34535/1979 and 1569/1980, and Japanese Patent O.P.I. Publication Nos. 33220/1975, 38526/1975, 107127/1976, 115820/1976, 135528/1976, 104916/1977 and 104917/1977.

In addition, descriptions concerning the combination of benzoxazolocarbocyanines (oxacarbocyanines) with other carbocyanines are found in, e.g., Japanese Patent Examined Publication Nos. 32753/1969 and 11627/1971, and Japanese Patent O.P.I. Publication No. 1483/1982, and descriptions concerning merocyanines are found in, e.g., Japanese Patent O.P.I. Publication Nos. 38408/1973, 4120/1973, 40662/1975, 25728/1981, 10753/1983, 91445/1983, 11645/1984 and 33823/1975.

And descriptions concerning the combination of thiacarbocyanines with other carbocyanines are found in, e.g., Japanese Patent Examined Publication Nos. 4932/1968, 4933/1968, 26470/1970, 18107/1971 and 8741/1972, and Japanese Patent O.P.I. Publication No. 114533/1984, and further, those methods using zeromethine or dimethine-merocyanine dyes, monomethine or trimethine-cyanine dyes and styryl dyes as described in Japanese Patent Examined Publication No. 6207/1974 may be advantageously used.

In order to incorporate these sensitizing dyes into the silver halide emulsion used in this invention, these dyes are used in the form of a dye solution prepared in advance by being dissolved into a hydrophilic organic solvent such as, e.g., methyl alcohol, ethyl alcohol, acetone, dimethyl formamide, or those fluorinated alcohols as described in Japanese Patent Examined Publication No. 40659/1975. The addition of these sensitizing dyes to the silver halide emulsion may be made at an arbitrary point of time such as in the beginning of, during, or at the end of the chemical ripening of the silver halide emulsion, or else, as the case may be, the addition may be made in the process immediately before the emulsion coating.

Where the silver halide photographic material of this invention should be constituted to be of a full color photographic material, green-sensitive and blue-sensitive silver halide emulsion layers are provided in addition to the red-sensitive silver halide emulsion layer containing the naphthol-type cyan coupler of this invention. The couplers to be incorporated into these green- and blue-sensitive emulsion layers are allowed to be of either the two-equivalent type or the four-equivalent type.

Effective examples of the yellow coupler to be contained in the foregoing blue-sensitive silver halide emulsion layer include open-chain ketomethylene compounds, and so-called two-equivalent couplers such as active-site-O-aryl-substituted couplers, active-site-O-acyl-substituted couplers, active-site-hydantoin compound-substituted couplers, active-site-urazole compound-substituted couplers, active-site-succinic acid imide compound-substituted couplers, active-site-fluorine-substituted couplers, active-side-chlorine or bromine-substited couplers, active-site-O-sulfonyl-substituted couplers, and the like. Concrete examples usable as the yellow coupler are found in U.S. Pat. Nos. 2,875,057, 3,265,506, 3,408,194, 3,551,155, 3,582,322, 3,725,072 and 3,891,445, West German Pat. No. 1,547,868, West German OLS Pat. Nos. 2,219,917, 2,261,361 and 2,414,006, British Pat. No. 1,425,020, Japanese Patent Examined Publication No. 10783/1976, and Japanese Patent O.P.I. Publication Nos. 26133/1972, 73147/1973, 102636/1976, 6341/1975, 123342/1975, 130422/1975, 21827/1976, 87650/1975, 82424/1977, 115219/1977 and 95346/1983, and the like.

Usable examples of the magenta coupler to be used in the foregoing green-sensitive silver halide emulsion layer include pyrazolone-type, pyrazolotriazole-type, pyrazolinobenzimidazole-type, indazolone-type compounds. These magenta couplers may be not only four-equivalent-type couplers but also two-equivalent-type couplers similarly to the foregoing yellow couplers. Concrete examples of such yellow couplers include those as disclosed in U.S. Pat. Nos. 2,600,788, 2,983,608, 3,062,653, 3,127,269, 3,311,476, 3,419,391, 3,519,429, 3,558,319, 3,582,322, 3,815,506, 3,834,908 and 3,891,445, West German Pat. No. 1,810,464, West German OLS Pat. Nos. 2,408,665, 2,417,945, 2,418,959 and 2,424,467, Japanese Patent Examined Publication No. 6031/1965, Japanese Patent O.P.I. Publication Nos. 20826/1976, 58922/1977, 129538/1974, 74027/1974, 159336/1975, 42121/1977, 74028/1974, 60233/1975, 26541/1976 and 55122/1978, and Japanese Patent Application No. 110943/1980.

Cyan couplers usable in combination with the naphthol-type cyan couplers of the present invention in the blue-sensitive emulsion layer include those phenol-type and naphthol-type cyan couplers outside this invention. These cyan couplers may be not only four-equivalent couplers but also two-equivalent couplers similarly to the foregoing yellow couplers. Concrete examples of such cyan couplers include those as described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 3,772,002, 3,933,494 and 4,004,929, West German OLS Pat. Nos. 2,414,830 and 2,454,329, Japanese Patent O.P.I. Publication Nos.

59838/1973, 26034/1976, 5055/1973, 146827/1976, 69624/1977, 90932/1977 and 95346/1983, and Japanese Patent Examined Publication No. 11572/1974.

The silver halide emulsion layers and other photographic component layers of this invention may use in combination other couplers such as non-diffusible DIR compounds, colored magenta or cyan couplers, polymer couplers, diffusible DIR compounds, and the like. Regarding such nondiffusible DIR compounds and colored magenta or cyan couplers, reference can be made to Japanese Patent Application No. 193611/1984, and regarding such polymer couplers, reference can be made to Japanese Patent Application No. 172151/1984.

As for the method of adding such non-invention couplers usable in this invention into the photographic component layers of this invention, reference can be made to the foregoing method of adding the naphthol-type cyan coupler of this invention.

The silver halide photographic material of this invention may contain various other additives including those antifoggants, stabilizers, ultraviolet absorbing agents, anticolor stain agents, brightening agents, antidiscoloration agents, antistatic agents, hardening agents, surface active agents, plasticizers, wetting agents, etc., as described in Research Disclosure 17643.

In the silver halide photographic material of this invention, the hydrophilic colloid for use in the preparation of the emulsion include proteins such as gelatin, gelatin derivatives, graft polymers of gelatin with other high-molecular materials, albumin, casein, etc.; cellulose derivatives such as hydroxyethyl cellulose, carboxymethyl cellulose, etc.; starch derivatives; homo- or copolymeric synthetic hydrophilic high-molecular materials such as polyvinyl alcohols, polyvinyl-imidazoles, polyacrylamides, etc.; and the like.

Suitably usable materials as the support of the silver halide photographic material of this invention are transparent support materials including cellulose acetate film, cellulose nitrate film, polyester film such as polyethylene terephthalate film, polyamide film, polycarbonate film, polystyrene film, and the like. Further, baryta paper, polyethylene-laminated paper, or a transparent support backed with a reflective material, or a glass plate may also be used as the support. These support materials may be selected arbitrarily according to the purpose for which the light-sensitive material is used.

The silver halide emulsion layers or other photographic component layers used in the present invention may be coated by various coating methods including dipping coating, air-doctor coating, curtain coating, hopper coating, and the like. And those simultaneous coating methods for coating two or more layers at the same time as described in U.S. Pat. Nos. 2,761,791 and 2,941,898 may also be used.

In the present invention, the coating positions of the respective emulsion layers may be arbitrarily settled. For example, in the case of a full-color-negative-type light-sensitive material, it is desirable to arrange in order from the support side a red-sensitive silver halide emulsion layer, green-sensitive silver halide emulsion layer, and blue-sensitive silver halide emulsion layer.

The following layer construction is known as means to increase photographic speed: For example, in the above-mentioned layer construction comprising a support having thereon sequentially coated red-sensitive silver halide emulsion layer, green-sensitive silver halide emulsion layer and blue-sensitive silver halide emulsion layer, there is known a layer construction in which, regarding part of or the whole of the light-sensitive silver halide emulsion layers, each individual layer is divided into a high-speed silver halide emulsion layer (hereinafter called high-speed emulsion layer) and a low-speed silver halide emulsion layer (hereinafter called low-speed emulsion layer), both having a substantially same color sensitivity and containing a substantially same color-forming nondiffusible coupler and being superposedly coated to be adjacent to each other. In addition, the above layer construction will be hereinafter called high-speed orderly layer construction.

On the other hand, the following techniques to form inverse layer constructions are known as means to accomplish a high photographic speed:

[A] Firstly, Japanese Patent O.P.I. Publication No. 49027/1976 describes a layer construction in which:

(a) A low-speed red-sensitive silver halide emulsion layer and a low-speed green-sensitive silver halide emulsion layer (RG low-speed layer unit) are coated in the described order from the support side, (b) on the RG low-speed layer unit are coated a high-speed red-sensitive silver halide emulsion layer and a high-speed green-sensitive silver halide emulsion layer (RG high-speed layer unit) in the described order from the support side, and (c) on the RG high-speed layer unit are coated in the same manner as in the orderly layer construction high-speed and low-speed blue-sensitive silver halide emulsion layer (B high/low-speed layer unit).

[B] And Japanese Patent O.P.I. Publication No. 97424/1978 describes the following construction: In the silver halide photographic material of the foregoing Construction [A], each of the red-sensitive silver emulsion layer and green-sensitive emulsion layer of the RG low-speed layer unit is divided into medium-speed and low-speed layers.

[C] Further, our Japanese Patent Application No. 52115/1983 describes a layer construction in which an RGB low-speed layer unit and the RG high-speed layer unit are coated on a support in the described order from the support side.

Any of the silver halide color photographic materials of these constructions [A], [B] and [C] has at least a high-speed red-sensitive silver halide emulsion layer between the high-speed green-sensitive silver halide emulsion layer and a green-sensitive silver halide emulsion layer whose speed is lower than the said high-speed green-sensitive silver halide emulsion layer, and these constructions are effective means to attain the object of a high speed and high image quality.

The present invention is suitably and effectively applicable to any of such silver halide color photographic materials of the above-described high-speed orderly layer construction and of the high-speed inverse layer construction.

In the silver halide photographic material of this invention, appropriate thickness-having interlayers may be arbitrarily provided according to the purpose for which the photographic material is used, and further, various other layers such as filter layers, anticurl layer, protective layer, antihalation layer, etc., may be used in arbitrary combination as part of the component layers. In such component layers the foregoing hydrophilic colloid usable in the emulsion layer may be used likewise as the binder. And in such layers the previously mentioned various photographic additives that may be incorporated into the foregoing emulsions may be incorporated likewise.

[Examples]

The present invention will be further illustrated in detail by the following examples, but the embodiment of this invention is not limited thereto.

EXAMPLE-1

$2\times10^{-2}$ moles of Exemplified Coupler (13) were dissolved by heating into a mixture of 15 ml of tricresyl phosphate and 30 ml of ethyl acetate, and the solution was mixed with 300 ml of an aqueous 5% gelatin solution containing 1.5 g of Alkanol B (alkylnaphthalene sulfonate, produced by DuPont), and this mixture was emulsifiedly dispersed by means of a colloid mill.

This coupler-dispersed liquid was mixed with 1 kg of a photographic emulsion containing 0.2 mole of a red-sensitive silver iodobromide (6 mole% of silver iodide and 94 mole% of silver bromide) and 40 g of gelatin, and to the mixture were added 20 ml of a 2% solution of a hardener 1,2-bis(vinyl-sulfonyl)ethane, and this liquid was then coated on a cellulose triacetate film base, and then dried. On this layer was further coated a gelatin protective layer, whereby a color light-sensitive material Sample (1) was prepared. The coating amount of silver of Sample (1) was 2 g/m$^2$.

Subsequently, Samples (2) and (3) were prepared in quite the same manner except that Exemplified Couplers (21) and (29) were used, respectively, in place of the Exemplified Coupler (13).

Further, Samples (4), (5) and (6) were also prepared in quite the same manner except that Comparative Couplers (A), (B) and (C) were used, respectively, in place of the Exemplified Coupler (1). These Samples (1), (2), (3), (4), (5) and (6) each was exposed through an wedge to light in usual manner, and then processed in accordance with the following processing procedure.

| Processing Steps (38° C.) | Processing Time |
|---|---|
| Color developing | 3 min. and 15 sec. |
| Bleaching | 6 min. and 30 sec. |
| Washing | 3 min. and 15 sec. |
| Fixing | 6 min. and 30 sec. |
| Washing | 3 min. and 15 sec. |
| Stabilizing | 1 min. and 30 sec. |

Compositions of the processing liquids which were used in the respective processes are as follows:

[Color Developer Composition (1)]

| | |
|---|---|
| 4-amino-3-methyl-N—ethyl-N—(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate, monohydrated | 2.5 g |
| Potassium hydroxide | 1.0 g |
| Water to make 1 liter. Adjust the pH to 10.0 by use of potassium hydroxide. | |

[Bleaching Bath Composition]

| | |
|---|---|
| Ammonium ethylenediamine tetraacetate | 100.00 g |
| Diammonium ethylenediamine tetraacetate | 10.0 g |
| Ammonium bromide | 150.0 g |
| Glacial acetic acid | 10.0 g |
| Water to make 1 liter. Adjust the pH to 6.0 by use of aqueous ammonia. | |

[Fixer Composition]

| | |
|---|---|
| Ammonium thiosulfate (50% aqueous solution) | 16.2 ml |
| Anhydrous sodium sulfite | 12.4 g |
| Water to make 1 liter. Adjust the pH to 6.5 by use of acetic acid. | |

[Stabilizer Composition]

| | |
|---|---|
| Formalin (37% aqueous solution) | 5.0 ml |
| Koniducks (product of Konishiroku Photo Industry Co., Ltd.) | 7.5 ml |
| Water to make 1 liter. | |

The obtained magenta color images each was measured with a red light by means of a densitometer PD-7R (manufactured by Konishiroku Photo Industry Co., Ltd.), thereby calculating a sensitivity [relative value to the sensitivity of Sample (4) which is regarded as 100], fog and maximum density. The obtained results are as given in Table 1.

TABLE I

| Sample No. | Coupler | Sensitivity (relative value) | Fog | Max. density |
|---|---|---|---|---|
| (1) | Exemplified coupler (13) | 153 | 0.10 | 3.10 |
| (2) | Exemplified coupler (21) | 149 | 0.09 | 3.03 |
| (3) | Exemplified coupler (29) | 146 | 0.09 | 3.05 |
| (4) | Comparative coupler (A) | 100 | 0.09 | 2.12 |
| (5) | Comparative coupler (B) | 125 | 0.24 | 2.83 |
| (6) | Comparative coupler (C) | 118 | 0.10 | 2.55 |

As is shown in Table 1, it is understood that Samples (1) through (3) which use the couplers of this invention have higher sensitivities and higher maximum densities than do Samples (4) through (6) and also have satisfactory color-forming characteristics with little or no increase in fog.

Comparative Coupler (A)

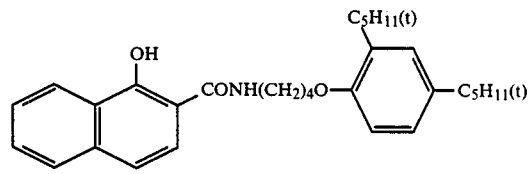

Comparative Coupler (B)

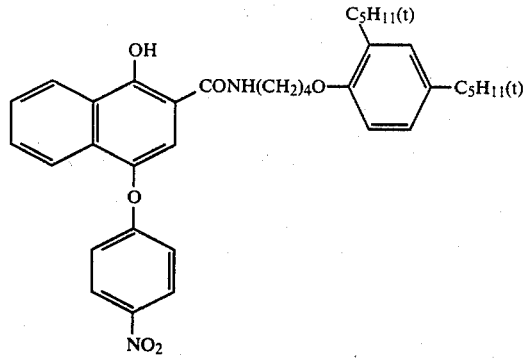

Comparative Coupler (C)

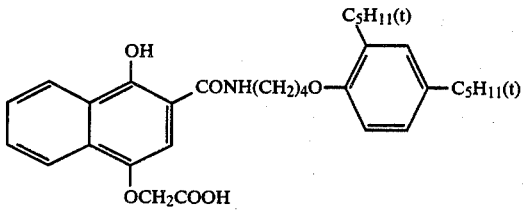

EXAMPLE-2

After coating and drying of Samples (1), (2), (3), (4), (5) and (6) of Example-1, the samples were allowed to stand unexposed for four days in a hermetical container containing a 1% aqueous formaldehyde solution in a darkroom, the samples being placed so as not to touch the formaldehyde solution. The thus treated samples and the untreated samples as comparative samples were each exposed and processed in the same manner as in Example-1, and then measured with respect to their sensitivities and maximum densities to thereby calculate the respective samples' resistance(%) against formalin (treated sample/untreated sample×100). The obtained results are as given in Table 2.

TABLE 2

| Sample No. | Resistance (%) against formalin | |
|---|---|---|
| | Change in sensitivity | Change in Max. denisty |
| (1) | 89 | 88 |
| (2) | 90 | 86 |
| (3) | 91 | 87 |
| (4) | 69 | 65 |
| (5) | 85 | 81 |
| (6) | 87 | 80 |

As is apparent from Table 2, it is understood that Samples (1) through (3), which use the couplers of this invention, hardly receive adverse effects such as the deterioration of the sensitivity and the deterioration of the maximum density due to the formalin as compared to Samples (4) through (6), so that the couplers of this invention are ones excellent in improving the preservability of unexposed raw photographic materials.

EXAMPLE-3

On a transparent polyethylene terephthalate film support were coated the following layers, whereby the following layer constructions-having high-speed multi-layered color negative photographic material Samples (7) and (8) were prepared.

First layer . . . antihalation layer:

A gelatin layer containing black colloidal silver (dry thickness 1μ).

Second layer . . . interlayer:

A gelatin layer containing 2,5-di-t-octylhydroquinone (dry thickness 1μ).

Third layer . . . red-sensitive low-speed emulsion layer:

A red-sensitive silver iodobromide emulsion layer (silver iodode 8 mole%, silver bromide 92 mole%, coating amount of silver 3.5 g/m$^2$, dry thickness 6μ) containing $6.8\times10^{-2}$ moles per mole of silver halide of a coupler 1-hydroxy-N-[4-(2,4-di-t-tert-pentylphenoxy)-butyl]-2-naphthoamide, $1.7\times10^{-2}$ moles per mole of silver halide of a colored coupler 1-hydroxy-N-{4-(2,4-di-t-amylphenoxy)butyl}-4-(2-ethoxycarbonyl-phenylazo)-2-naphthoamide, and $4\times10^{-2}$ mole of a development inhibitor-releasing-type compound 2-(1-phenyl-5-tetrazolylthio)-4-(2,4-di-t-amylphenoxy-acetamido)-1-indanone.

Fourth layer . . . red-sensitive high-speed emulsion layer:

A red-sensitive silver iodobromide emulsion layer (silver iodide 5 mole%, silver bromide 95 mole%, coating amount of silver 1 g/m$^2$, dry thickness 2μ) containing $1\times10^{-2}$ moles per mole of silver halide of Exemplified Coupler (50), $1\times10^{-2}$ moles per mole of silver halide of a colored coupler (the same as the one used in the above third layer), and $2\times10^{-2}$ of a development inhibitor-releasing-type compound (the same as the one used in the above third layer).

Fifth layer . . . interlayer:

The same as the second layer.

Sixth layer . . . green-sensitive emulsion layer:

A green-sensitive silver iodobromide emulsion layer (silver iodode 8 mole%, silver bromide 92 mole%, coating amount of silver 1 g/m$^2$, dry thickness 3.5μ) containing $5.8\times10^{-2}$ moles per mole of silver of a coupler 1-(2,4,6-trichlorophenyl)-3-{3-[α-(2,4-di-tert-amyl)-phenoxy]acetamido}benzamido-5-pyrazolone, $1.7\times10^{-2}$ mole of a colored coupler 1-(2,4,6-trichlorophenyl)-3-(2-chloro-5-octadecenylsuccinimidoanilido)-4-(4-hydroxyphenylazo)-5-pyrazolone, and $7\times10^{-3}$ moles of a development inhibitor-releasing compound 2-(1-phenyl-5-tetrazolylthio)-4-(2,4-di-t-amylphenoxy-acetamido)-1-indanone.

Seventh layer . . . interlayer:

The same as the second layer.

Eighth layer . . . yellow filter layer:

A gelatin layer (dry thickness 1μ) containing yellow colloidal silver and 2,5-di-t-octylhydroquinone.

Ninth layer . . . blue-sensitive emulsion layer:

A blue-sensitive silver iodobromide emulsion layer (silver iodide 7 mole%, silver bromide 93 mole%, coating amount of silver 1.2 g/m$^2$, dry thickness 7μ) containing $2.5\times10^{-1}$ moles per mole of silver halide of a coupler 2-(2,2-dimethylpropionyl)-2-(1-benzyl-2-phenyl-3,5-dioxo-1,2,4-triazolidine-4-yl)-2'-chloro-5'-(α-dodecyloxycarbonyl-ethoxycarbonyl)acetanilide and $5\times10^{-3}$ moles of a development inhibitor-releasing compound (DIR material) W-bromo-ω-(1-phenyl-5-tetrazolylthio)-4-lauroylamidoacetophenone.

Tenth layer . . . protective layer:

A gelatin layer (dry thickness 1μ).

The above respective layer were thus coated. The sample whose fourth layer contains Exemplified Compound (50) was regarded as Sample (7). Sample (8) was prepared in the same manner as in Sample (7) except that Comparative Coupler (D) was used in place of the Exemplified Compound (50) in the fourth layer.

These Samples (7) and (8) each was exposed through an wedge to a red light and processed in the same manner as in Example-1, and then the sensitivity (relative value to the sensitivity of Sample (8) regarded as 100), fog, and maximum density were calculated. The obtained results are as given in Table 3.

Comparative Coupler (D)

TABLE 3

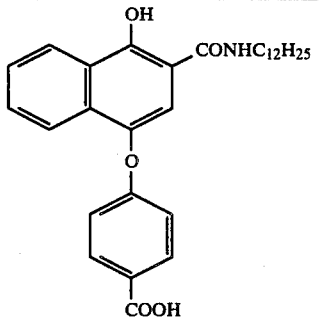

| Sample No. | Sensitivity (relative value) | Fog | Max. density |
|---|---|---|---|
| (7) | 137 | 0.07 | 2.85 |
| (8) | 100 | 0.07 | 2.03 |

As is apparent from Table 3, it is understood that Sample (7), which uses the coupler of this invention, has a higher sensitivity and higher maximum density than does Sample (8), and has no tendency of an increase in fog, so that it is very effective even when used in making a multilayer film. Accordingly, the use of the coupler of this invention enables the preparation of a high-speed color film, or economization of silver and reduction of the using amount of couplers to thereby enable the preparation of a thin-layer photographic light-sensitive material.

Further, as a result of testing the resistance to formalin in the same manner as in Example-2, quite the same effects as in Example-2 were obtained.

EXAMPLE-4

Samples (7) and (8), which were used in Example-3, were allowed to stand unexposed in an incubator whose inside was conditioned at 55° C./40%RH for three days, and after that were each exposed through an wedge to a red light, and then processed in the same manner as in Example-1, and subsequently the samples each was measured and calculated with respect to the fog and change in the sensitivity (%)(treated sample/untreated sample×100).

TABLE 4

| Sample No. | Fog | Change in sensitivity |
|---|---|---|
| (7) | 91 | 0.15 |
| (8) | 78 | 0.23 |

As is apparent from Table 4, it is understood that Sample (7), which uses the coupler of this invention, has a smaller fog and smaller change in the sensitivity than do Sample (8), which uses a comparative coupler, and therefore is a light-sensitive material excellent in the preservability in the form of a raw photographic material.

What is claimed is:

1. A silver halide photographic material containing a cyan coupler represented by the formula:

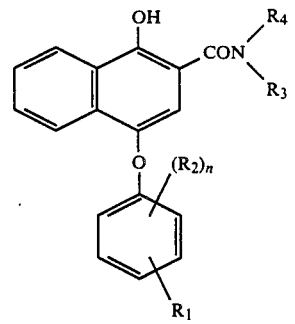

wherein, $R_1$ is selected from the group consisting of an acylamino group, an alkylsulfonamido group, an arylsulfonamido group, a carbamoyl group, a sulfamoyl group, an alkylureido group, an arylureido group, an alkyl group, an alkoxy group, an amino group, an alkoxycarbonyl group and an arylcarbonyl group, said groups have at least one carboxyl group as a substituent, $R_2$ is selected from the group consisting of a hydrogen atom, a halogen atom, an alkyl group, an alkoxy group, a nitro group, a cyano group, a formyl group, a carboxyl group, a hydroxyl group, an amino group, an acylamino group, an alkylsulfonamido group, an arylsulfonamido group, an alkylureido group, an arylureido group, a sulfamoyl group, a carbamoyl group, an alkoxycarbonyl group and an aryloxycarbonyl group, $R_3$ represents an alkyl group substituted with a phenoxy group, $R_4$ represents a hydrogen atom or an alkyl group, n represents an integer of 1 to 4, provided that when n is 2 or more the groups represented by the plurality of $R_2$ may be either same or different from each other, and that the total number of carbon atoms contained in the groups represented by $R_3$ and $R_4$ is 10 or more.

2. The silver halide photographic material of claim 1, wherein $R_1$ is selected from the group consisting of an acylamino group, an alkylsulfonamido group and an arylsulfonamido group, said group being substituted by at least one carboxyl group as a substituent.

3. The silver halide photographic material of claim 2, wherein $R_1$ is a 3-carboxyl-propaneamido group.

4. The silver halide photographic material of claim 1, wherein $R_2$ is selected from the group consisting of a hydrogen atom, a nitro group, an acylamino group, an alkylsulfonamido group, and an arylsulfonamido group.

5. The silver halide photographic material of claim 4, wherein $R_2$ is a 3-carboxyl-propaneamido group.

6. The silver halide photographic material of claim 1, wherein $R_4$ is a hydrogen atom.

7. The silver halide photographic material of claim 1, wherein the group represented by $R_1$ is substituted by a substituent other than a carboxyl group and said substituent contains as a substituent said carboxyl group.

8. The silver halide photographic material of claim 3, wherein said cyan coupler is the compound represented by the formula [I];

Formula [I]

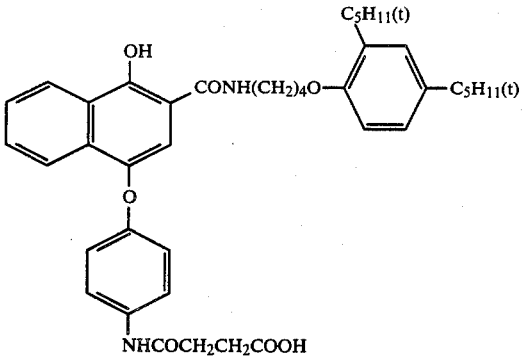
9. The silver halide photographic material of claim 5, wherein said cyan coupler is the compound represented by the formula [II];
Formula [II]
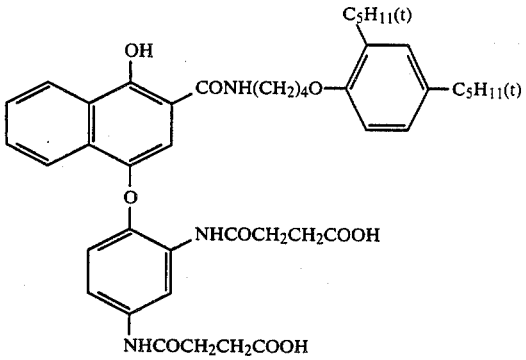
* * * * *